United States Patent [19]

Willis et al.

[11] 4,274,497

[45] Jun. 23, 1981

[54] SKIRTED HAMMER SUB FOR DUAL TUBE DRILLING

[75] Inventors: Clyde A. Willis, Wichita; George A. Ford, Houston, both of Tex.

[73] Assignee: Walker-Neer Manufacturing Co., Inc., Wichita Falls, Tex.

[21] Appl. No.: 786,449

[22] Filed: Apr. 11, 1977

[51] Int. Cl.[3] ..... E21B 49/02

[52] U.S. Cl. ..... 175/100; 175/215

[58] Field of Search ..... 175/100, 215, 213, 401, 175/340, 393; 173/73

[56] References Cited

U.S. PATENT DOCUMENTS

| | | | |
|---|---|---|---|
| 2,807,443 | 9/1957 | Wyman | 175/393 X |
| 3,151,690 | 10/1964 | Grable | 175/215 X |
| 3,208,539 | 9/1965 | Henderson | 175/215 |
| 3,596,720 | 8/1971 | Elenburg | 175/215 X |
| 3,667,555 | 6/1972 | Elenburg | 175/100 X |
| 3,978,923 | 9/1976 | Ford | 175/215 X |
| 3,991,834 | 11/1976 | Curington | 175/215 X |

*Primary Examiner*—James A. Leppink

*Attorney, Agent, or Firm*—Hume, Clement, Brinks, Willian & Olds, Ltd.

[57] ABSTRACT

A skirted crossover sub for joining an air hammer to a string of dual concentric drill pipe is characterized by passageways for directing air from the pipe string annulus to operate the hammer and for directing exhaust air and cuttings from the hammer bit to the inner pipe of the string. A tubular skirt at the downhole end of the sub surrounds the hammer and channels the flow of exhaust air therebetween. A packer and uphole reamer may be included, as well as valves for air lift and for providing proper air flow direction in the borehole annulus.

13 Claims, 6 Drawing Figures

SKIRTED HAMMER SUB FOR DUAL TUBE DRILLING

BACKGROUND OF THE INVENTION

Traditional percussion drilling of wells and boreholes in the earth with pneumatically-operated downhole hammers is a well-developed art. High penetration rates in hard formations make this an attractive drilling method in mining, quarry, construction, water well, oil well and geophysical applications. A typical system employs a string of conventional drill pipe and an air hammer which drives a percussion bit. Air from a surface compressor is directed down the pipe to operate the hammer, and the entire string is usually rotated. The air exhausts through the bit at the bottom of the hole and returns to the surface through the annular space between the hole wall and the drill string (the borehole annulus).

A major problem with such a system is the need for relatively high air compressor capacity. In order to ensure proper bailing of cuttings from the bottom of the hole, upward annular air velocities in the borehole annulus of at least 4,000 feet per minute are usually recommended. Such a flow is expensive and difficult to achieve, particularly where the bit is of appreciably larger diameter than the drill string, resulting in a large borehole annulus. Other problems include lost circulation, dust control, sample contamination, formation water, sticking and the like.

Attempts to solve these and other problems have heretofore been proposed involving the use of dual concentric drill pipe in conjunction with pneumatic hammers. In such systems, the air for operating the hammer is directed down the annular conduit (the pipe annulus) defined between the inner and outer tubes of the pipe string, and at least a portion of the exhaust air and entrained cuttings is directed to the surface through the central conduit defined by the inner tube of the pipe string. One such system is proposed in U.S. Pat. No. 3,299,971. The patentee suggests, however, that pressurized fluid be introduced into the borehole annulus to insure movement of fluid down the hole, around the bit and up the inner tube. A similar system is proposed in U.S. Pat. No. 3,871,486. There the patentees suggest that a major portion of the exhaust air be directed up the borehole annulus. Thus neither system takes full advantage of the enclosed circulation available with dual tube pipe. Moreover, both patents disclose and depend upon "hollow" or axial flow hammers and bits suitable for cutting cores. Such hammers do not appear to be readily available commercially—probably due to technical problems of design and manufacture—and certainly are not stock items.

Another approach is proposed in U.S. Pat. Nos. 3,667,555 and 3,747,698, which utilize conventional air hammers which are widely available in various sizes and configurations. In order to adapt such a non-axial flow hammer for use with dual tube pipe, the patentees disclose cross-over subs which direct drilling fluid from the pipe annulus to operate the hammer and which direct exhaust air and cuttings into the inner tube. The former patent also teaches that a portion of the drilling fluid from the annular conduit should be injected into the borehole annulus uphole from the sub.

These systems do not completely overcome the drawbacks of the prior art. For one thing, the borehole annulus around the hammer itself remains large, making it difficult to achieve the annular air velocity required to insure proper removal of cuttings. Moreover, there is a tendency toward sticking due to small cuttings or "fines" lodging in the borehole annulus or bypassing the sub entirely. Finally, the injection of a portion of the drilling fluid into the borehole annulus above the sub to maintain a constant uphole flow in the borehole is inefficient.

SUMMARY OF THE INVENTION

The present invention provides a system for utilizing a conventional fluid-operated hammer with a string of dual concentric drill pipe which overcomes the foregoing disadvantages of the prior art. The principal goal of the present invention is to minimize or eliminate drilling fluid circulation in the borehole annulus, thus taking full advantage of the enclosed circulation characteristics of a dual tube drilling system. In accordance with the invention, there is provided a crossover sub for joining a fluid-operated hammer to a joint of pipe or other element of a dual tube drill string. The sub includes means for directing drilling fluid from the annular conduit of the drill string to operate the hammer, and means for directing exhaust fluid and cuttings from the bit to the central conduit of the drill string. The sub is provided with a skirt which encircles the hammer body and defines therebetween an annular flow space which serves to channel the flow of exhaust fluid and cuttings into the sub and to reduce the effective size of the borehole annulus around the hammer. A system utilizing the sub may also include a packer and/or a reaming collar. Means may be provided below the packer for injecting fluid from the pipe annulus into the borehole annulus to insure a fluid flow down around the bit. Similar means may be at or above the reaming collar to assist in withdrawal of the drill string. Finally, means for injecting air from the annular conduit into the central conduit may be utilized at a point above the hammer to induce a pressure drop in the central conduit and enhance the upward flow of exhaust air and cuttings inside the skirt.

Additional objects and features of the invention will become apparent upon consideration of the following description, with reference to the drawings, in which.

DESCRIPTION

Figure 1:
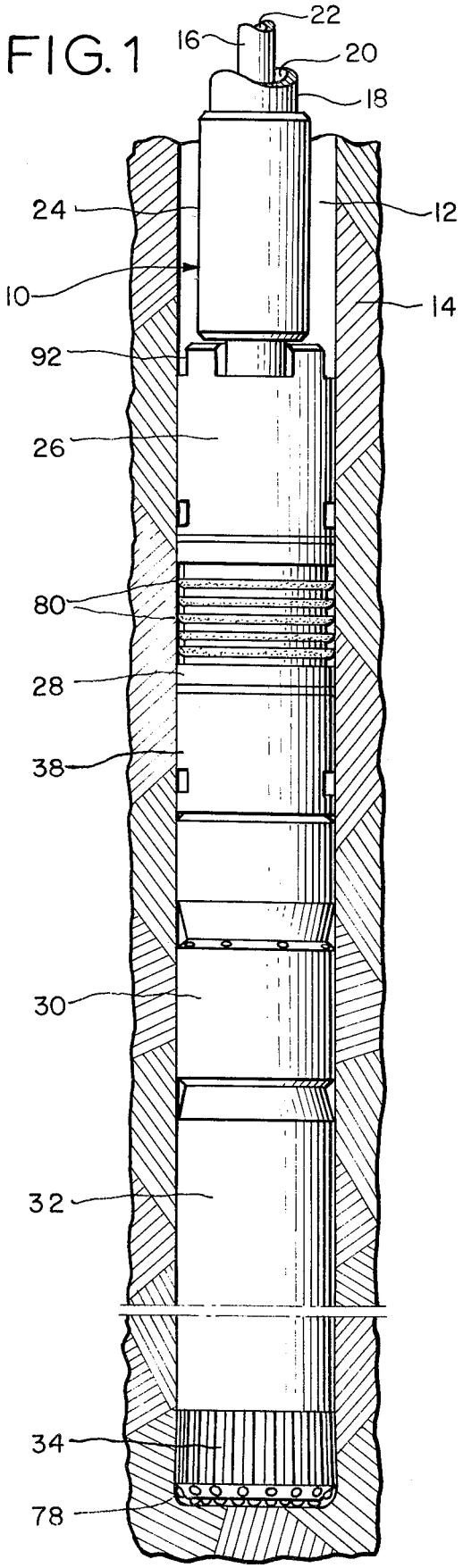
FIG. 1 is an elevational view, showing a portion of a dual tube drilling system embodying the present invention.
Figure 4:
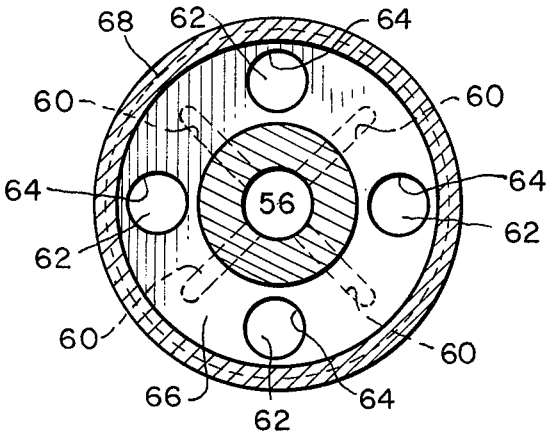
FIG. 4 is a transverse cross sectional view taken on the line 4—4 of FIG. 3.

With reference to the drawings there is shown in FIG. 1 a dual tube drilling system embodying the present invention. As shown therein, a dual tube drill string, generally denoted by the numeral 10, is in position in a borehole 12 formed in an earth formation 14. The drill string 10 is characterized by an inner tube 16 and an outer tube 18. The inner tube 16 is concentrically disposed within the outer tube 18, and the two tubes define therebetween an annular conduit 20. The inner tube 16 itself defines a central conduit 22. Typically, in drilling with such a string of dual tube pipe, drilling fluid is directed downhole through the annular conduit 20 to the vicinity of a bit or other tool. The drilling fluid, with entrained cuttings, then returns to the surface through the central conduit 22. A suitable construction for dual tube pipe is disclosed in U.S. Pat. No. 3,208,539.

Attached to the lowermost segment of dual tube pipe in the string 10 is an air injection sub 24. Attached to the air injection sub 24 is a reaming sub 26. The next element, attached at the downhole end of the reaming sub 26, is a packer sub 28. Below the packer sub 28 is a skirted crossover sub 30. The crossover sub 30 terminates in a fluid-operated hammer 32 which carries a percussion bit 34. The construction and operation of the subs 24, 26, 28 and 30, and their relationship to the hammer 32, are described in greater detail below with reference to FIGS. 2–6.

Figure 2:
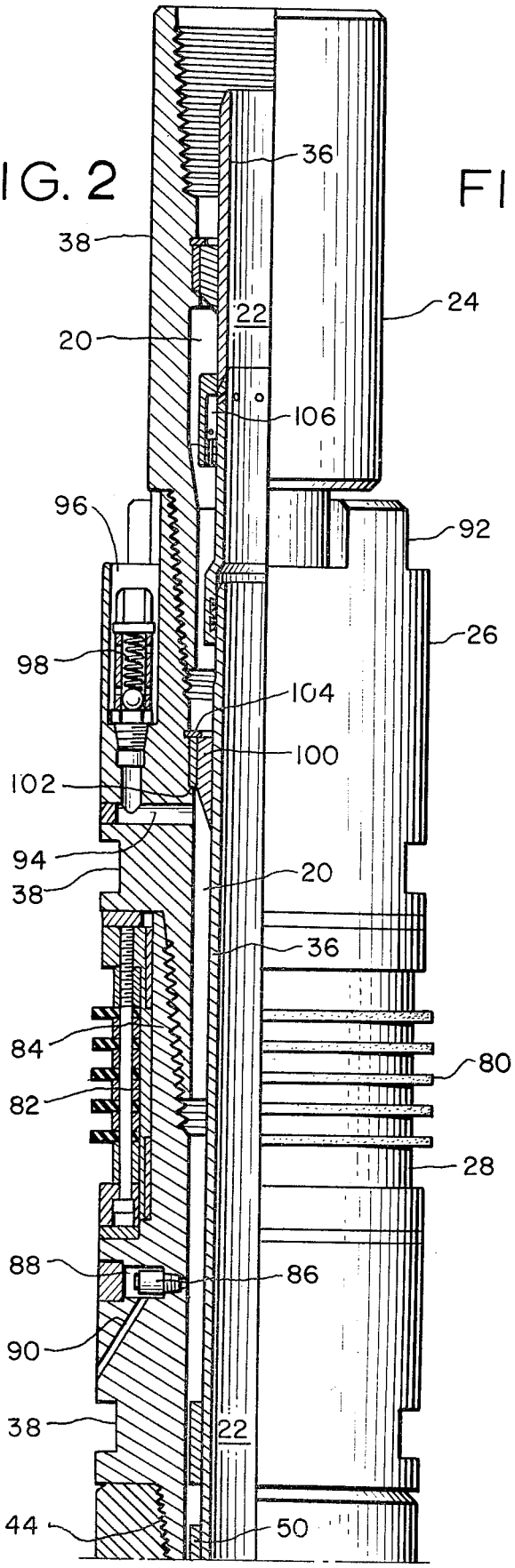
FIG. 2 is an elevational view, partially in section, of a portion of a system shown in FIG. 1.

As shown in FIG. 2, the subs 24, 26 and 28 each include an inner tubular element 36 which serves to define a continuation of the central conduit 22 defined by the inner tube 16 of the pipe string 10. Similarly, the subs 24, 26 and 28 include outer tubular element 38 which concentrically enclose the inner tubes 36 and define therebetween a continuation of the annular conduit 20 defined between the inner and outer tubes 16 and 18 of the pipe string 10.

Figure 3:
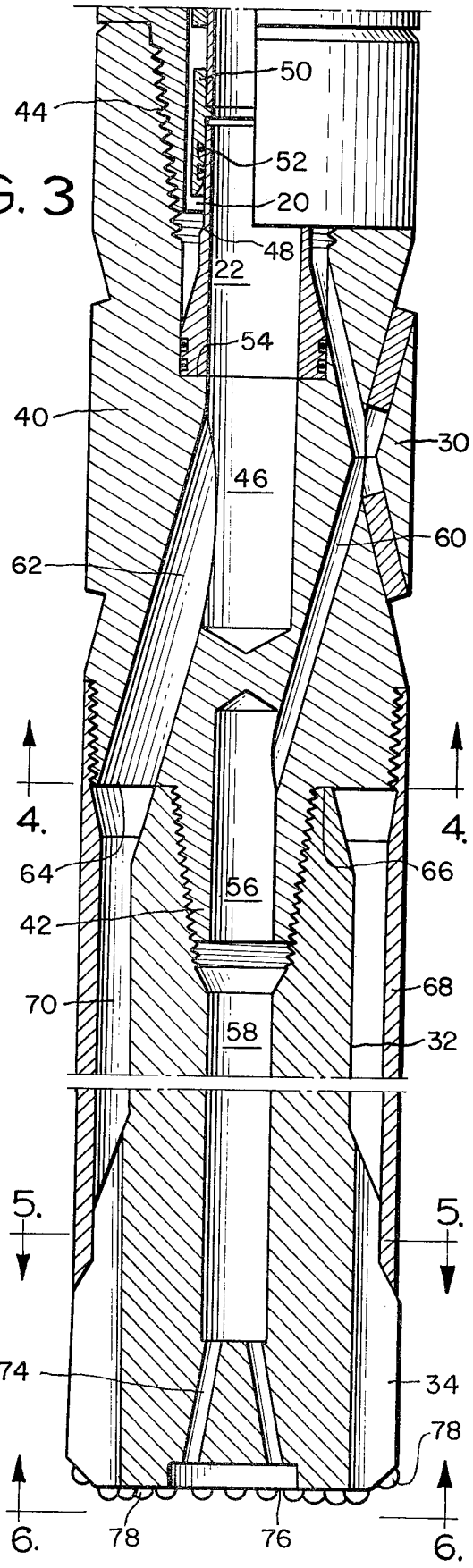
FIG. 3 is a view similar to that of FIG. 2, showing another portion of the system of FIG. 1.

As best seen in FIG. 3, the crossover sub 30 comprises a cylindrical body 40 which is adapted at its lower end to mate with the hammer 32, by means of a threaded pin 42. In like manner, the crossover sub 30 is adapted at its up-hole end to mate with the pin of the packer sub 28, by means of threaded box 44.

The crossover sub 30 includes a central passageway 46 which is defined at its upper end by an inner tubular element 48. The inner tube 48 of the crossover sub 30 mates telescopically with the inner tube 36 of the packer sub 28 by means of a sleeve 50 having O-ring seals 52. Indeed, the inner tubes of the various subs and other elements of the dual tube pipe string 10 can be advantageously interconnected in this manner to achieve a fluid-tight seal with resulting isolation of the annular and circular conduits 20 and 22 throughout the length of the system. The inner tube 48 of the crossover sub 30 defines with the body 40 a continuation of the annular conduit 20. The lower end of the inner tube 48 is flared to form a seal against a shoulder 54 formed within the body 40, thus closing off or dead-ending the annular conduit 20.

At the downhole end of the crossover sub 30 there is formed a central passageway 56 which communicates with a central passageway 58 in the hammer 32. A series of lateral passageways 60 are formed in the body 40 to direct drilling fluid from the annular conduit 20 to the lower passageway 56. In this manner, drilling fluid from the annular passageway 20 is directed to the hammer 32 for operation thereof. A second set of lateral passageways 62 are formed in the body 40 and define orifices 64 at their points of emergence through the downhole shoulder 66 of the body 40.

Figure 5:
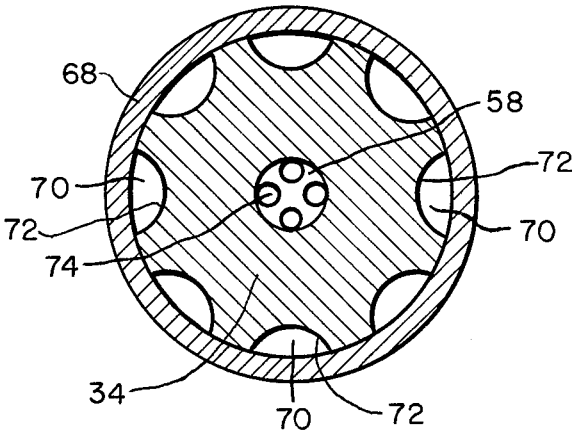
FIG. 5 is a transverse cross sectional view taken on the line 5—5 of FIG. 3.
Figure 6:
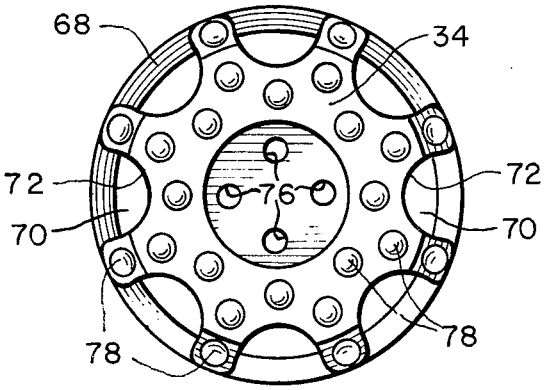
FIG. 6 is an end view taken on the line 6—6 of FIG. 3.

A tubular skirt 68 is attached to the body 40 of the crossover sub 30 near its downhole end, and extends downwardly to embrace the bit 34. As can be seen, the skirt 68 completely surrounds or encircles the hammer 32 and defines therebetween an annular flow passage 70. As best shown in FIGS. 5 and 6, the bit 34 is provided with flutes 72 which define channels for the upward flow of drilling fluid and cuttings from the bottom of the hole. The lower end of the skirt 68 surrounds the flutes 72 thus channeling virtually all of the upward flow into the annular space 70. As shown in FIGS. 3 and 6, the bit 34 is provided with fluid passageways 74 which terminate in exhaust orifices 76. Thus, the exhaust flow from the hammer 32 exits the bit 34 through the orifices 76 at the cutting face of the bit and carries cuttings upwardly through the flutes 72 and into the annular space 70.

The hammer 32 is of conventional design, and its interior construction is not shown in detail. Similarly, the bit 34 is of conventional design, having a series of cutting buttons 78 on its cutting face. A very satisfactory type of pneumatic hammer for use in the present invention is the "MEGADRIL" and the corresponding "MEGABIT" discussed in "Operation and Maintenance Manual No. 105" published by TRW Mission Manufacturing Company, Division of TRW, Inc. Many other fluid-operated hammers and percussion bits are available for use with present invention.

As best shown in FIG. 2, the packer sub 28 includes a series of flexible annular packet rings 80 mounted rotatably, by means of a sleeve bearing 82, on a mandril 84. Suitable constructions for such a packer sub are disclosed in co-pending application for U.S. Pat., Ser. No. 618,811, filed Oct. 2, 1975. The packer sub 28 also includes a set of check valves 86 located in chambers 88 formed in the outer tube 38 of the sub 28. The valves 86 isolate the chambers 88 from the annular passageway 20. A series of fluid passageways 90 are formed in the outer tube 38 and serve to direct fluid from the chambers 88 into the borehole 12. Thus, when the valves 86 are opened, drilling fluid is able to pass from the annular conduit 20 into the borehole 12.

Also as shown in FIG. 2, the reamer sub 26 includes at its up-hole end a series of reaming cutters 92. Passageway 94 terminate in orifices 96 which open into the borehole 12 between the reaming cutters 92. Check valves 98 isolate the orifices 96 from the passageways 94. Thus, when the check valves 98 are open, drilling fluid is permitted to pass from the annular conduit 20 out the orifices 96 and into the borehole 12.

The inner tube 36 of the reamer sub 26 is suspended within the outer tube 38 by means of a spider or lugs 100 which rest on an internal shoulder 102 and are held in place by a snap ring 104. Indeed, this means of suspending the inner tube within the outer tube may be advantageously employed in any of the subs or sections of pipe which make up the dual tube string 10.

As best seen in FIG. 2, the air injection sub 24 includes an annular valve arrangement 106 which permits drilling fluid to pass from the annular conduit 20 into the central conduit 22. A suitable construction for the sub 24 is disclosed in U.S. Pat. No. 3,978.923.

The operation of the system may now be described with particular reference to FIGS. 2 and 3. Drilling fluid from a suitable source (not shown) at the surface of the earth is pumped downhole through the annular conduit 20. The drilling fluid (e.g. compressed air) continues downhole and is routed through the passageways 60 in the cross-over sub 30 into the passageway 56 which communicates with the central opening 58 of the hammer 32. The compressed air causes the hammer 32 to operate and is exhausted through the bit orifices 76. The exhaust air, with entrained cuttings, then passes upwardly through the flutes 72 in the bit 34 and into the annular space 70. The exhaust air then reenters the cross-over sub 30 through the orifices 64 and passes upwardly through the passageways 62 and into the central passageway 46 which is a continuation of the central conduit 22. Finally, the exhaust air and cuttings return to the surface within the inner tube 16 of the pipe string 10.

The outer diameter of the skirt 68 is preferably almost the same or slightly less than the effective cutting diameter of the bit 34, thus providing minimal clearance between the skirt 68 and the hole wall for the escape of exhaust air and cuttings into the borehole 12. The goal of the present invention is to channel all, or virtually all of the exhaust air and cuttings into the annular space 70, and to eliminate or virtually eliminate upward circulation in the borehole 12. To assist in achieving this goal, the check valves 86, which may be set to open at relatively low pressure (e.g. 15 pounds per square inch) permit a downward flow of air through the passageways 90 into the borehole 12. This downward flow of air in the borehole 12 assists in preventing the upward movement of dust and fine cuttings in the borehole.

The packer members 80 on the packer sub 28 serve to pack off or close the borehole annulus 12 above the bit, and further prevent the upward flow of air and cuttings in the borehole. In addition, the packer members 80 serve to prevent formation water encountered in the borehole 12 above the packer sub 28 from entering the borehole in the vicinity of the bit, thus reducing back pressure on the hammer 32.

The reaming cutters 92 on the reaming sub 26 assist in withdrawal of the drilling string 10 from the hole 12. During the drilling operation, the entire pipe string 10 is typically rotated, using suitable surface equipment (not shown). Continuing this rotation during withdrawal of the drill string 10 will cause the reaming cutters 92 to ream out the hole. The withdrawal of the drill string 10 is further assisted by setting the check valves 98 to operate at a relatively high pressure (e.g., 200 pounds per square inch). Thus, during withdrawal of the pipe string 10, the pressure of the air supplied by the surface compressor may be increased above that required to operate the hammer 32, thus causing the valves 98 to open. The consequent high flow of air upward into the bore annulus 12 through the orifices 96 assists in removing any cuttings or other debris which may accumulate above the reaming cutters 92.

Finally, the check valve arrangement 106 in the air injection sub 24 may be set to provide a continuous flow of air from the annular conduit 20 into the central conduit 22. This diffusion of air into the central conduit 22 results in an air-lift effect, enhancing the bailing of the hole 12 through the inner conduit 22. In addition, the injection of air into the inner conduit 22 induces a pressure drop therein, thus enhancing the flow of exhaust air upwardly through the flutes 72 of the bit 34 and into the annular space 70, and reducing back pressure on the hammer 32.

The skirt 68 not only channels the flow of exhaust air around the hammer 32, but also effectively reduces the annular flow space around the hammer. Thus, it would be also possible to reduce the air required for proper bailing of the hole by providing a crossover sub with outfacing intake orifices and permitting the exhaust air to flow outside the skirt in the borehole annulus 12.

It should be understood that not all of the components of the system disclosed herein are required for effective utilization of the invention. The essential components are a crossover sub and a skirt which defines an annular flow space around the hammer. The other components of the system, such as the packer 28, the reamer 26, the air injection sub 24 and the valves 86 and 98 may be employed as necessary to optimize performance of the system under various drilling conditions.

We claim:

1. A crossover sub for interconnecting a dual concentric drill string with a fluid hammer for driving a percussion bit, comprising:

means for receiving fluid from the annular space defined between the inner and outer tubular elements of said drill string;

means for directing said fluid to said hammer for operation thereof;

a tubular skirt at one end of said sub adapted to encircle said hammer and to define therebetween means for receiving exhaust fluid and entrained cuttings from said bit; and means for directing said exhaust fluid and entrained cuttings into the inner tubular element of said drill string.

2. A sub as defined in claim 1, wherein said skirt defines, with the outer surface of said hammer, an annular space therebetween for directing said exhaust fluid and entrained cuttings from the vicinity of said bit to the vicinity of said means for receiving exhaust fluid and entrained cuttings.

3. A sub as defined in claim 1, wherein the outer diameter of said skirt is slightly less than the effective cutting diameter of said bit.

4. A skirted crossover sub for joining a fluid hammer with a dual concentric drill string, said hammer being adapted to drive a fluted percussion bit and said drill string comprising interengageable elements each including concentrically disposed tubular members arranged to define isolated, continuous central and annular fluid flow conduits, said sub comprising:

a cylindrical body;

means at the downhole end of said body for securing said hammer thereto in fluid-tight relation;

means at the uphole end of said body for securing one of said drill string elements thereto in fluid-tight relation;

means defining a first passageway in said body for directing fluid from said annular flow conduit to said hammer;

means defining a second passageway in said body for directing exhaust fluid from said bit to said central flow conduit; and a tubular skirt at the downhole end of said body surrounding said hammer and defining therebetween an annular space adapted to conduct exhaust fluid from said bit to said means defining a second passageway.

5. A sub as defined in claim 4, wherein said skirt encompasses both the uphole exits of the flutes in said bit and the entrance to said second passageway, thus providing fluid communication therebetween through said annular space.

6. A drilling system for forming a borehole comprising:

a dual concentric drill string having interengageable elements including tubular members concentrically disposed to define central and first annular conduits;

a fluid operated hammer;

a bit adapted to be driven by said hammer;

means for directing fluid from said first annular conduit to operate said hammer;

skirt means surrounding said hammer and providing a second annular conduit therebetween for the flow of exhaust fluid from said bit; and means for receiving exhaust fluid from said second annular conduit and directing same to said central conduit.

7. A system as defined in claim 6, including means in said drill string for injecting fluid from said first annular conduit into said central conduit.

8. A system as defined in claim 6, including means for injecting fluid from said first annular conduit into said borehole in a downhole direction.

9. A system as defined in claim 6, including packer means uphole from said hammer for preventing uphole flow of said exhaust fluid in said borehole.

10. A system as defined in claim 6, including a reaming collar uphole from said hammer.

11. A system as defined in claim 10, including means for injecting fluid from said first annular conduit into said borehole in an uphole direction at or uphole from said reaming collar.

12. A system as defined in claim 9, including means downhole from said packer means for injecting fluid from said first annular conduit into said borehole.

13. A system as defined in claim 9, including means uphole from said packer means for injecting fluid from said first annular conduit into said borehole.

* * * * *